United States Patent [19]

Soderberg

[11] Patent Number: 4,490,095

[45] Date of Patent: Dec. 25, 1984

[54] OILWELL PUMP SYSTEM AND METHOD

[76] Inventor: Paul B. Soderberg, 1716 Huge Oaks, Houston, Tex. 77055

[21] Appl. No.: 308,847

[22] Filed: Nov. 19, 1981

[51] Int. Cl.[3] ..... F04B 47/08

[52] U.S. Cl. ..... 417/46; 417/390; 417/392; 417/401; 417/435

[58] Field of Search ..... 417/20, 46, 211.5, 390, 417/392, 401, 435

[56] References Cited

U.S. PATENT DOCUMENTS

| | | | |
|---|---|---|---|
| 376,382 | 1/1888 | Hearn | 417/378 |
| 2,744,469 | 5/1956 | Schaefer | 417/435 |
| 3,123,007 | 3/1964 | Orr | 417/390 X |
| 4,120,612 | 10/1978 | Brown | 417/390 X |

*Primary Examiner*—Leonard E. Smith

*Attorney, Agent, or Firm*—Browning, Bushman, Zamecki & Anderson

[57] ABSTRACT

A method, system and apparatus is disclosed for pumping liquid from a well such that vapor lock of the pump cannot occur due to gas or steam and such that the pump strokes only in response to the production rate of well liquid. The pump can be used for lifting heavy oils heated by steam floods or the like as well as for pumping liquids from conventional wells. Reduced pump wear, reduced energy requirements, reduced maintenance and the automatic adaption to changing well production rates are among the objects of this invention.

8 Claims, 4 Drawing Figures

OILWELL PUMP SYSTEM AND METHOD

TECHNICAL FIELD

This invention relates generally to methods and means for pumping liquid from oil and gas wells and more particularly, it relates to methods and means for pumping "heavy oils" for which no satisfactory remedies have been available heretofore. "Heavy oil" reservoirs are abundant but production from such formations have been extremely limited due to a viscosity comparable to tar. Attempts to heat the heavy oil as by steam flooding so as to lower its viscosity and thereby render it more flowable, have met with some success however, pumps used tend to "vapor lock" which prevents formation oil from flowing into the pump chamber so as to be pumped to the surface. Due to the high temperature of the heated oil, conventional pumping equipment is not suitable for pumping such oils because of the effect of temperature on seal materials and the like and because any water present in the produced fluids will flash into steam as it enters the pump chamber, which together with gas in the produced fluids will tend to "vapor lock" a conventional pump, causing it to repeatedly stroke without pumping fluid and thereby destroy itself in a short time by generating heat not carried off by produced fluids.

Due to the world wide energy shortage, it is necessary that energy-efficient and cost-effective means be provided for pumping "heavy oils" from producing formations, such that pump means are operable in the presence of heavy-oils and such that no vapor lock occurs and such that pump strokes occur only after the pump chamber has filled with fluid to be produced.

BACKGROUND ART

Conventional "barrel-type" reciprocating bottom hole pumps have been used for many years as evidenced by the many thousands of pump-jacks across the country, each pump-jack reciprocating a sucker-rod string disposed vertically into a well so as to actuate the pump therein. Typically, the pump body is suspended near the bottom of a tubing string such that the pump is in the liquid to be pumped from the well. A conventional pump body is usually made from a joint of tubing and has an inlet to receive liquid from the producing formation into the pump chamber or "barrel." A piston is reciprocated within the pump chamber, allowing liquid to pass through a first check valve into the pump chamber during the return stroke and forcing that liquid up through a second check valve into the production tubing on the pump stroke. The piston is affixed to a piston rod of greater length than the pump stroke so as to allow the rod to pass through and be sealed by a seal member which prevents back flow from the production tubing into the pump chamber.

Although methods have been devised to vary the speed and lengths of pump strokes in an attempt to adjust to changing well conditions, such pumps do not pump at precisely the rate that the well may be producing at any given time. Such a mismatch often leads to: a lower production rate if the pumping is at too low a rate; or to pump damage and a waste of energy when the pump operates faster than the formation is then producing. Such pumps are also suseptable to vapor-lock wherein gas or vapor accumulates in the pump chamber and expands during the return stroke and thereby exerts a pressure within the pump chamber which in turn prevents liquid from filling the pump chamber whereupon the next pump stroke can pump only a fraction of its rated volume.

Although such pumps have operated reasonably well at low pressures and at shallow depths, they are not suited to operate while submerged in hot liquids as occurs in the steam flooding of formations producing heavy oils. Not only would seal materials fail but sucker-rod expansion due to the heat would inhibit proper performance as would reciprocation of sucker rods through the thickening heavy oil as it cools as it flows toward the surface.

The use of sucker rods in crooked holes causes extreme wear on both the rods and the casing which in turn invites casing failure, down time and loss of production.

Both rotary and reciprocating downhole pumps have been driven by pumping a portion of the fluid produced back down the hole through a separate conduit to actuate a bottom hole pump and then to exhaust into the production tubing and return to the surface along with new liquid from the formation. Such an arrangement requires that the power fluid pumped down be at a much higher pressure than the formation pressure. Also it is required that the net volume of oil produced is substantially less than the total volume pumped up the tubing because some must be returned to power the bottom hole pump. Such pumps are also subject to vapor-lock as well as the obvious loss of energy required to continually circulate the high pressure, power fluid. Since fluid produced from the formation will have fine sand particles entrained therein, so will the fluid separated at the surface for use as power fluid, making it necessary to filter and degas the fluid before admitting it to a high pressure surface pump. Even though filtered, fine abrasive particles remain in the fluid and act to damage the surface pump and the downhole pump as well.

Various gas lift methods have been employed on wells of limited depth. However, such a practice can be economically justified only if a sufficient quantity of gas at an excessive pressure is available. By nature, gas lift is inefficient and the cost to repressure gas for lifting a high liquid-gas ratio well is no longer practical as it might have been when gas was of little value. Various methods are disclosed in U.S. Pat. Nos. 1,845,181; 3,410,217; 3,941,510 and 3,991,825, none of which would be practical for use in deep wells or for lifting heavy oil. Expansion of the gas would cool the heavy oil to a nonflowable condition and thereby lock up the tubing.

Therefore, some objects of this invention are to provide methods, means, and systems to pump liquids from wells such that: vapor-lock of the pump does not occur; the pump is operated so as not to allow damage to pump parts caused by unnecessary contact with the produced fluid; the pump does not stroke unless the pump chamber is full of liquid; no sucker-rods are required to operate within a column of heavy-oil; no recirculation of a fluid to the pump is required; the pump chamber pressure may be reduced to as low as atmospheric pressure while formation fluid is flowing into the pump chamber so as to maximize the differential flowing pressure and thereby increase productivity of the producing formation; pumping of the well is effected with substantial savings of energy.

The first paragraph of U.S. Pat. No. 3,123,007 discloses a pump "employing a reciprocating column of liquid to operate the reciprocating plumger or traveling valve of a pump", in the first paragraph thereof, and as discussed in column 1, line 36, "The present invention provides an actuator for a well pump of conventional design". The same patent also discloses the actuator to employ an annular piston as in column 1, line 56. Many other patents disclose similar devices but lack the intelligence in the downhole pump itself to sence when the pump chamber is full of liquid, as does the subject invention.

DISCLOSURE OF INVENTION

This invention provides a new and novel method, means and system for pumping liquid from a well of any depth without vapor-lock and without loss of volumetric efficiency of the pump. This invention also provides means to pump hot oils, as may be necessary in oil wells producing heavy-oils after steam flooding, such that water in the produced fluid does not cause vapor-lock as it flashes into steam within the pump chamber.

A reciprocating pump member which may be a piston, a diaphragm or such operating within a pump chamber is caused to begin a pump stroke only after the pump chamber is filled with liquid, substantially all gas and vapor that has entered the pump chamber from the producing formation, having been vented to the surface. Venting of gas and vapor may be accomplished through a vent valve mounted with the upper fixed end of the pump chamber such that as gas, vapor and liquid from the producing formation enter the lower portion of the pump chamber but above the piston, through suitable mounted inlet ports or inlet check valves, gas and vapor rise above the liquid and pass through the vent valve and through a suitable vent passage to the surface. Just as liquid rises to the top of the pump chamber to fill it completely with liquid, a float of sufficient bouancy for operation in the liquid acts to close the vent valve and thereby prevent liquid from entering the vent valve. Closing of the vent valve triggers a signal generator-transmitter which may then cause a surface mounted receiver-controller to actuate a pump stroke of high volumetric efficiency. As the piston is powered upwardly, an inlet check valve may close and liquid is forced through an outlet check valve mounted with the upper fixed end of the pump chamber, and through the production string toward the surface until the piston reaches the uppermost position, being stopped by contact with the upper fixed end of the pump chamber or other suitable stop means.

To power the pump stroke as described above, the receiver-controller, upon receiving a suitable signal from the generator-transmitter, may close a vent valve mounted on a power conduit extending from a fluid pressure source at the surface to a pressure chamber mounted below the piston such that as the controller acts in sequence to open a valve from the fluid pressure source, fluid pressure at a predetermined pressure level is admitted from the pressure source through the power conduit to the pressure chamber below the piston so as to drive the piston upwardly through the power stroke. As the piston reaches the uppermost position and contacts stop means as described above, the pressure source may then increase pressure in the power conduit to a level above that necessary to operate the piston power stroke such that the increased pressure triggers a preset pressure switch mounted with the power conduit to cause the controller to close the valve from the power source and to open the vent valve mounted with the power conduit so as to reduce the pressure in the power conduit and in the pressure chamber below the piston, to hydrostatic pressure only. Piston return means of suitable force to overcome the hydrostatic force acting below the piston may then return the piston to its lower-most position to begin filling of the pump chamber as described above for the next pump stroke. Piston return means may comprise a mechanical coil spring, a gas chamber or any suitable means to achieve proper piston return. As the piston begins its return stroke, the outlet check valve closes and inlet check valves open wherepon the vent valve is opened by the float being of suitable weight and having lost bouancy as the piston returns to its lowermost position to create temporarily an empty pump chamber. It is therefore evident that fluid reciprocates in the power conduit and in the pressure chamber, which with the spring member, causes the piston to reciprocate so as to pump liquid to the surface. Because fluid in the power conduit is not subject to contamination by mingling with fluids from the producing formation, no filtering, degassing, chemical treatment or such is required as is the case with conventional fluid-powered downhole pumps and additionally, an optimum power fluid may be used, selected for best service at service conditions such as temperature, depth, viscosity, density and such, practically without regard to cost of the fluid.

The pump of this invention may be installed to the well by any of several means such as lowering the pump within an intermediate string of casing by means of a centrally disposed string of production tubing sealably attached to the top of the pump, so as to allow an outwardly disposed shoulder formed around the pump to be sealingly supported by an inwardly disposed radial flange formed around the bottom of the intermediate casing string. The annulus between the production string and the intermediate casing string may be used as the power conduit and the annulus outwardly of the intermediate casing string may be used as the vent path. Liquid flowing up through the production tubing may flow through a conventional wellhead manifold to conventional storage tanks or flow lines.

The surface pressure source may comprise a conventional surface mounted pump or other suitable sources of pressurized fluids arranged to supply the power fluid at sufficient pressures and flow rates as required to operate the pump, upon the opening of a valve communication with the fluid pressure power source and the power conduit, on command from the controller.

The signal generator, transmitter, receiver and controller may be of any compatible conventional type such as sonic, electrical, pneumatic or hydraulic, depending on well conditions and owner preference. An ultrasonic transmitter-receiver combination is depicted on the drawings whereas an electrical line would be required between an electrical transmitter-receiver combination and a pressure conduit would be required between the pneumatic or hydraulic combination.

Although conventional inlet and outlet check valves are depicted and described, other valves such as slide valves may be used without departing from the spirit and scope of this invention.

Mounting of the valve may be any of several conventional means such as being run in attached to the lower end of the tubing string, being pumped through the tubing or being run through the tubing on a wire line or a string of smaller tubing.

The embodiment described below and depicted in the drawings, routes produced well liquids up the tubing, power fluid to operate the pump through the smaller annular passage and vented gas through a second annular passage. However, other suitable routings including small tubings run through the production tubing or an annulus may be used without departing from the spirit or scope of the present invention.

DESCRIPTION OF THE PREFERRED EMBODIMENT

Figure 1:
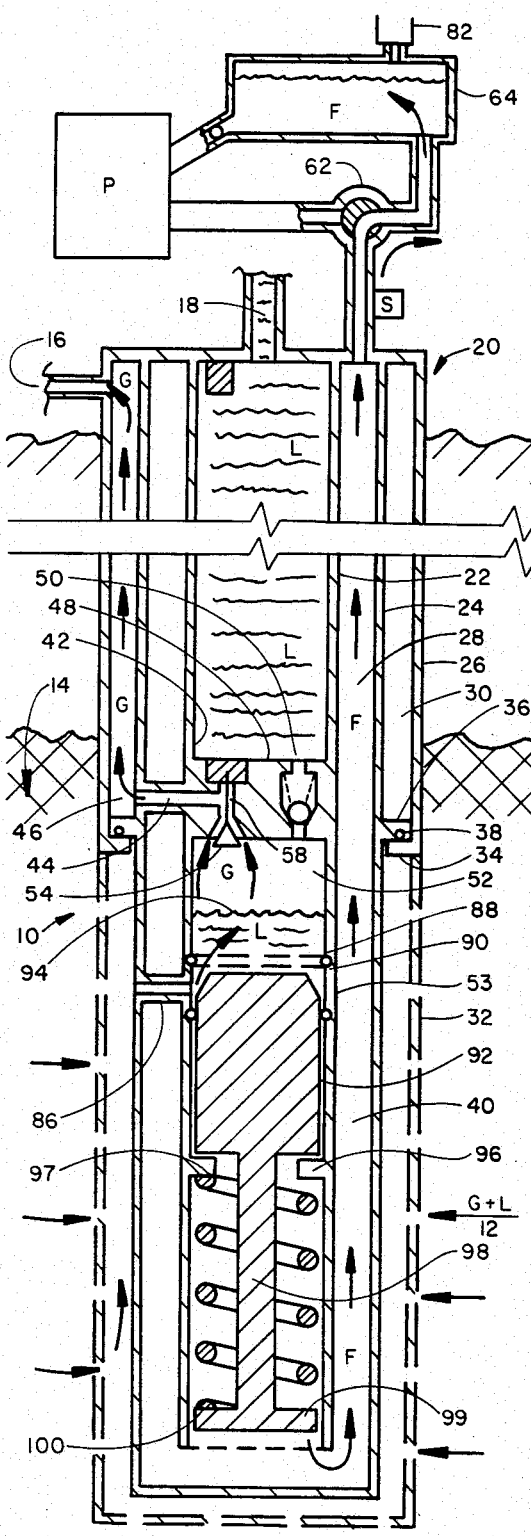
FIG. 1 is a schematic of a vertical section of a well producing both gas and liquids, comprising the present invention wherein well fluid is allowed to flow from the producing formation into the pump chamber because the piston is at the bottom of its stroke.
Figure 2:
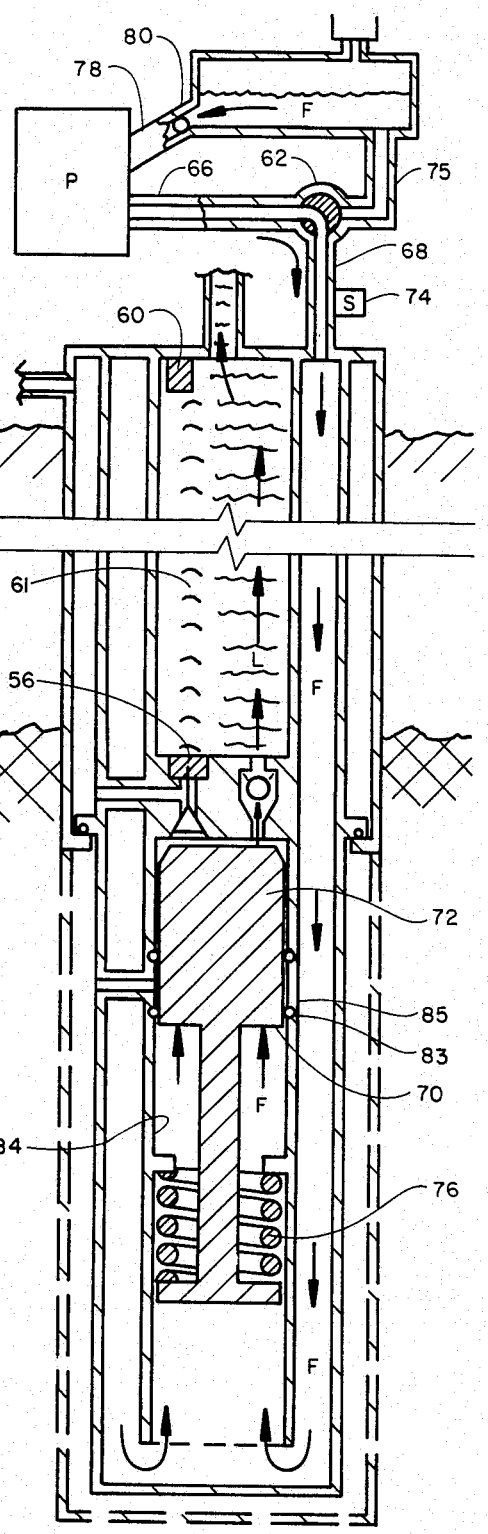
FIG. 2 is similar to FIG. 1 except that the piston is at the top of its stroke, after forcing liquid toward the surface.

As shown in FIGS. 1 and 2 well 10 producing both liquid and gas as at 12 from formation 14 by method, system and means for the present invention, gas (G) being produced at the surface from flowline 16, liquid being produced at the surface from flowline 18. A conventional wellhead 20 may be used for providing mounting and sealing attachment with production tubing 22, and casing strings 24 and 26. Produced liquids (L) flow up through tubing 22 to flowline 18, power fluid (F) flows through annulus 28 formed around tubing 22 within casing 24, and produced gas (G) flows upwardly through annulus 30 formed around casing 24 and within casing 26 to flowline 16. Screen 32 may be connected to the lower end of casing 26 so as to prevent particles of sand and gravel from flowing into the well from the formation. Shoulder 34 may be formed inwardly on the lower end of casing 26 for supporting the lower portion of casing 24 having shoulder 36 formed outwardly for cooperation with shoulder 34. Shoulder 36 may be provided with seal 38 for sealing the lower end of annulus 30. Pump 40 may be attached to the lower end of tubing 22 as at 42 in any suitable manner so as to register gas passage 44 in sealing communication with passage 46 through the wall of casing 24. Pump 40 comprises upper end wall 48 which may house: liquid outlet check valve 50 for passing liquid from pump chamber 52 formed by tubular member 53, to within tubing 22 only; vent valve 54 for passing only gas from pump chamber 52 to passage 44, vent valve 54 sized of suitable material so as to be closed when emersed in well liquid due to its bouancy and being open when not emersed in well liquid due to its weight in gas. End wall 48 may also house conventional generator-transmitter 56 arranged to be triggered by stem 58 of vent valve 54 when vent valve 54 moves from open position as shown in FIG. 1 to the closed position of FIG. 2.

Receiver-controller 60 may be mounted with the upper portion of tubing 22 so as to receive signals as at 61 from generator-transmitter 56 so as to direct motor valve 62 to move to the position as shown in FIG. 2 such that power fluid (F) is allowed to flow from pressure source (P) through conduits 66 and 68 and annulus 28 to act against the lower end 70 of piston 72. Pressure switch 74 may be mounted with conduit 68 to sense a predetermined level of pressure of power fluid (F) so as to direct motor valve 62 to move to the position as shown in FIG. 1 such that power fluid (F) is allowed to flow from annulus 28, through conduits 68 and 75 to surface tank 64 as spring 76 returns piston 72 from the upper position as shown in FIG. 2 to the lower position as shown in FIG. 1. Conduit 78 may be connected so as to return power fluid from surface tank 64 to power source (P) for reuse during another pump cycle, check valve 80 preventing flow from the pressure source to tank 64 which may cause overpressure of the tank. Pressure relief valve 82 may be set at atmospheric pressure as a vent or may be set at some higher pressure so as to balance the bottom hole pressure of the power fluid with the formation pressure and spring 76 as be desired for most efficient operation of the system. Power source (P) may be a conventional pump, a gas-over-liquid accumulator or other well-known sources of fluid power. Although power fluid (F) is depicted as a liquid, should a source of pressurized gas as from another well be available, conduit 78 may be omitted such that gas may flow to move the piston up per FIG. 2 and then may be allowed to flow out conduit 76 to a flowline not shown.

Piston 72 maintains slidable sealing contact with inner wall 84 of pump chamber 52 by means of annular seal 85 positioned within groove 83 formed in wall 84 so as to prevent co-mingling of power fluid (F) and well liquid (L) or well gas (G). Conduit 86 allows well fluids to flow from formation 14 through screen 32 through the wall of casing 24, through the wall of tubular member 53 and into pump chamber 52 when piston 72 is in its lowermost position depicted in FIG. 1. Annular seal 88 suitably mounted within groove 90 formed with the inner wall 84 of the pump chamber is positioned so as to contact cylindrical surface 92 of piston 72 as shown in FIG. 2, after piston 72 begins upward movement from its lowermost position.

Liquid-gas interface 94 of FIG. 1 rises as liquid and gas flow into chamber 52, gas passing through vent valve 54, conduit 44, annulus 30 to flowline 16 until vent valve 54 closes to initiate a pump cycle as described herein below.

Tubular member 53 may be provided with inwardly displaced radial shoulder 96 for supporting end 97 of spring 76 against upward movement such that spring 76 can provide sufficient force to return piston 72 to its lowermost position against the pressure of the power fluid as in FIG. 1. Piston 72 may be formed with stem 98 having outwardly disposed shoulder 99 to act against lower end 100 of spring 76 so as to transmit a downwardly acting force from spring 76 to piston 72.

FIG. 2 depicts a generator-transmitter 56 and receiver-controller 60 as being of a sonic or sonar type. However, other suitable conventional subsystems such as electrical, pneumatic or hydraulic may be employed without departing from the spirit or scope of this invention. Such other subsystems may require a cable or conduit (not shown) between the transmitter and receiver but well known in the art.

Although FIGS. 1 and 2 depict conduits 44 and 86 being formed integral with tubing 22 and casing 24, it should be understood that any number of suitable connections, seals and supports may be utilized so as to adapt system components for best installation, operation and maintenance for any given well conditions.

Figure 3:
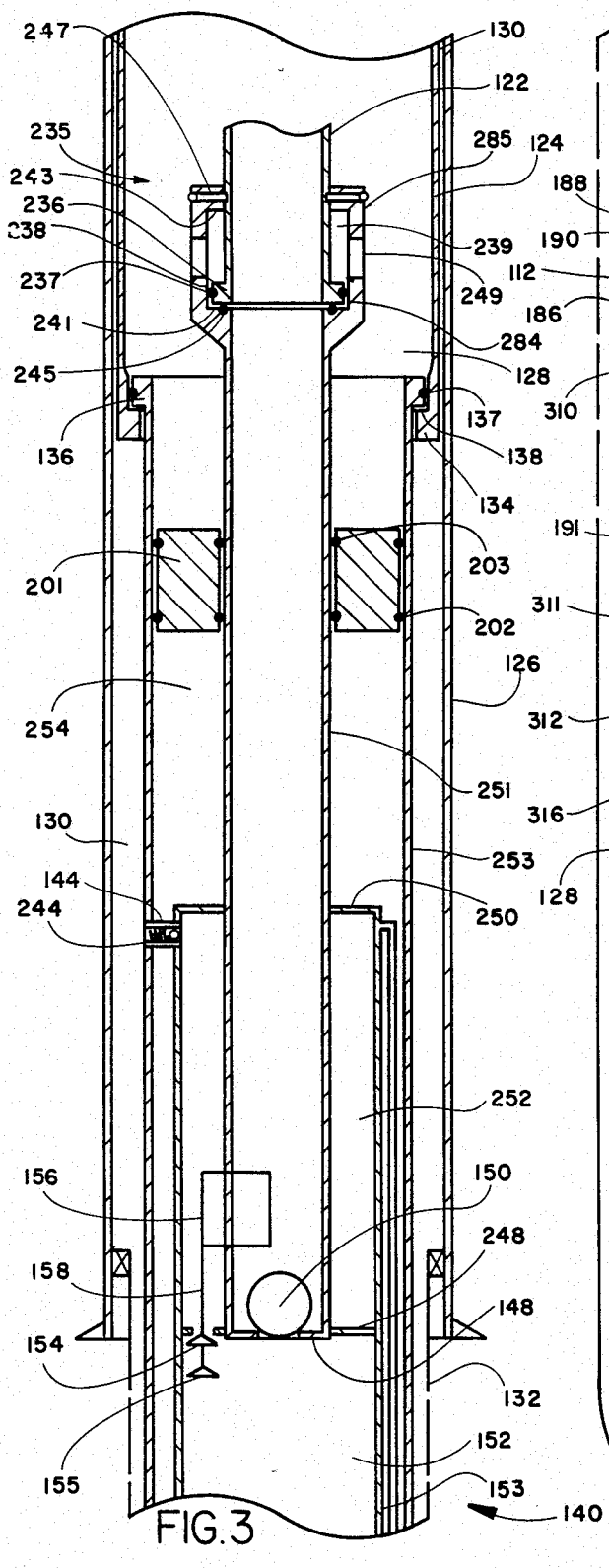
FIGS. 3 and 4 illustrate one embodiment of the pump of the present invention, the upper part in FIG. 3 and the lower part in FIG. 4.
Figure 4:
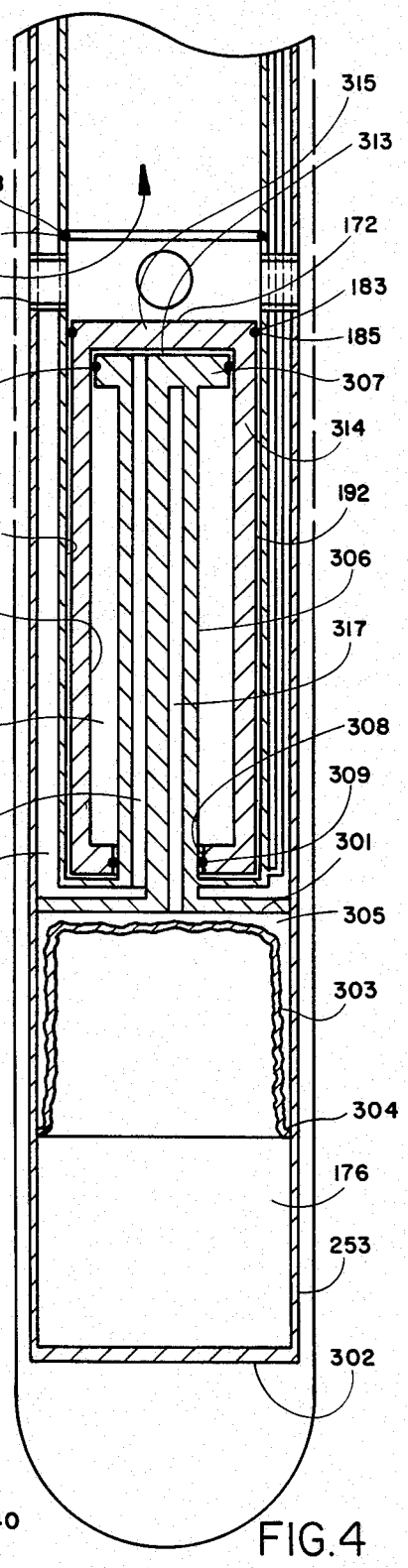

For conditions where it is desired that the pump be run into the hole by means of the production tubing 122, FIG. 3 depicts a preferred embodiment of the pump of the present invention generally depicted at 140, suspended and sealed at the lower end of casing by means of inwardly disposed annular shoulder 134 formed on casing 124 outwardly disposed annular shoulder 136 formed on the upper end of tubular member 253 and shoulder seal 138 and annular seal 137. Outer casing 126 may be formed at its lower end so as to receive and suspend well screen 132 for purposes described above. The inner wall of casing 126 and the outer wall of casing 124 form annular passage 130 and the inner wall of casing 124 and outer wall of tubing 122 form annular passage 128.

The lower portion of tubing 122 may comprise a side door valve shown generally at 235 to enable the operator to selectively circulate down the tubing 122, through valve 235 and up annulus 128. The construction of valve 235 may include outwardly extending annular shoulder 236 formed around the lower end of tubing 122, shoulder 236 formed with groove 238 so as to retain annular seal 237 for sealing contact between shoulder 236 and inner cylndrical surface 284 of body 285. Annular recess 239 formed between end shoulders 241 and 243 within body 285 provide for an axial length sufficient for shoulder 236 to reciprocate therein. Shoulder seal 245 may be provided for sealing between the lower surface of shoulder 236 and shoulder 241 of valve body 235. Shear pins as at 247 may be provided to maintain valve 235 closed as shown in FIG. 3 until removal of the pump is desired. Side ports as at 249 are provided through the wall of body 235 so as to allow liquid from within tubing 122 to flow around the lower surface of shoulder 236, through ports 249 and into annulus 128 after pins 247 are sheared, tubing 122 is lifted up through recess 239 so as to disengage seals 237 and 245, for purposes to be described below.

The lower end of valve body 285 may comprise tubular conduit 251 having end wall 148 for support of and sealing engagement with ball check 150 arranged to allow fluid flow from pump chamber 152 into conduit 251 only. Conduit 251 is retained centrally disposed within tubular member 153 by means of connecting walls 248 and 250 so as to form annular chamber 252 of sufficient volume to allow for proper operation of the pump as later described. Vent valve 154 may be provided with float 155, float 155 having sufficient bouancy in the produced well liquid so as to close the vent valve immediately before liquid rises to the vent valve level, within chamber 152. Sonic generator-transmitter 156 may be mounted with conduit 251 so as to be triggered by the closing of vent valve 154 to thereby transmit a proper signal to receiver-controller 160 as described above. Conduit 144 connecting annular chamber 252 with annulus 130 may be provided with a check valve as at 244 so as to allow gas to flow from space 252 into annulus 130 but to prevent well fluid from rising in annulus 130 and entering chamber 252. Annular piston 201 may be provided for operation within tubular member 253 and around tubular conduit 251, piston 201 having conventional sliding seals as at 202 and 203 respectively, axial movement of piston 201 being limited by the lower surface of valve body 285 and end wall 250, such that a selected operating fluid 254 may be used in annulus 128 below piston 201, fluid 254 being more suitable for flow through lower passages of the pump than power fluid (F) above piston 201 in annulus 128. Pump chamber 152 is formed by tubular member 153, end walls 148, 248 and piston 172 with sufficient length to allow for a full stroke of piston 172. When piston 172 is as its lowermost position as shown in FIG. 3, well fluid may flow from the producing formation, through ports 186 and into pump chamber 152. As the upper end of piston 172 rises past ports 186 and the outer cylindrical wall 192 engages annular seal 188 within annular groove 190 formed in inner wall 191 of chamber 152, flow is stopped through ports 186 to thereby allow piston 172 to force liquid up past ball check 150 toward the surface. Sliding annular seal 185 may be mounted within groove 183 formed in inner wall 191 for sealing cooperation with outer surface 192 of piston 172 so as to prevent downward leakage past the piston for the full stroke.

Whereas FIGS. 1 and 2 depict coil spring 76, FIG. 3 depicts a gas spring which may be used to approximate a constant force spring and thereby reduce the range of pressure required of the power fluid (F). End wall 301 within tubular member 253 defines the lower extremity of annulus 128 and the upper extremity of fluid chamber 176, chamber 176 being further defined by tubular member 253 and lowermost end wall 302. Bladder 303 is attached around the inner surface of tubular member 253 as at 304 so as to maintain separate, gas below the bladder and a suitable operating fluid above the bladder, the gas being charged to a pressure level suitable for operation under given well conditions which imparts the same pressure to the operating fluid 305 above the bladder. Centrally disposed rod 306 may be mounted with and project upwardly from end wall 301, terminating with annular flange 307. Piston 172 is formed at its lower end with bore 308 sized for close sliding fit around rod 306 such that annular seal 309 mounted in the wall of bore 308 maintains a sliding seal against fluid from either direction. Annular seal 310 is suitably mounted with annular flange 307 so as to provide a sliding seal against inner wall 311 of enlarged bore 312 immediately above bore 308. Chamber 313 is formed by tubular wall 314 of piston 172, end wall 315 of piston 172 and annular flange 307 such that the volume of chamber 313 will increase as piston 172 rises and will decrease as piston 172 decends with respect to flange 307. Fluid passage 316 is internal to and axially aligned with rod 306 so as to provide for communication of fluid 254 between chamber 313 and annulus 128. Fluid passage 317 is internal to and axially aligned with rod 306 so as to provide for communication of fluid 305 between enlarged bore 312 and chamber 176, above bladder 303. It may thus be understood that a compressed gas in chamber 176 and below bladder 303 will serve as a spring to store energy from and return energy to fluid 305 which in turn flows through passage 317 to and from enlarged bore 312. As fluid 254 is forced at sufficient pressure down annulus 128, up passage 316 and into chamber 313 to act against end wall 315, piston 172 may be caused to move upwardly against well fluid within pump chamber 152 and against the pressure of fluid 305 within enlarged bore 312. Such movement will cause fluid 305 to flow from bore 312, through passage 317 and into chamber 176 above bladder 303 which in turn forces the bladder downwardly and thereby further compresses gas below the bladder. It may also be understood that when the pressure of fluid 254 within chamber 313 is reduced to a sufficient pressure level by reducing the pressure within annulus 128, the pressure of the compressed gas within chamber 176 will be sufficient to reverse flow of fluid 305 so as to return piston 172 to its lowermost position.

The construction of FIG. 3 allows for casing 126, screen 132 and casing 124 to be installed in a conventional manner after which the pump of the invention may be lowered within casing 124 by means of production tubing 122 so as to be supported by shoulder 134 on the lower end of casing 124 as shoulder 136 is landed thereon to also effect sealing action of seals 137 and 138 so as to seal annulus 128 from communication with annulus 130.

OPERATION OF THE INVENTION

The system and method of operation of the invention may be best understood by referring to FIGS. 1 and 2. Now referring to FIG. 1, operating fluid (F) is allowed to return to tank 64 from annulus 28 due to the position of motor valve 62 such that the pressure of fluid (F) acting upwardly on piston 72 is reduced to a pressure level not sufficient to hold the piston upwardly against the force of spring 76 thereby allowing spring 76 to move piston 72 to its lowermost position per FIG. 1. Also, any gas that may have accumulated within pump chamber 52 is vented to the surface through open vent valve 54, gas passage 44, annulus 30 and flow line 16 so as to maintain a pressure within pump chamber 52 low enough for formation fluid to readily flow into chamber 52.

As both gas and liquid flow from formation 14 through screen 32, particles of sand and gravel are retained with the formation and gas and fluid continue flowing through conduits as at 86 into pump chamber 52. As the gas-liquid interface rises within chamber 52, gas is continually vented to the surface as previously described until such time that liquid rises to the level of vent valve 54 which thereby increases bouancy of the valve so as to close as depicted in FIG. 2 and prevent liquid from entering the vent. Per FIG. 2, the closing of vent valve 54 moves stem 58 upwardly to trigger signal generator-transmitter 56 and cause it to transmit a sonic signal 61 upwardly through production tubing 22 to receiver-controller 60 which in turn directs motor valve 62 to move to the position as depicted in FIG. 2 so as to allow fluid from pressure source (P) to increase the pressure of fluid (F) sufficiently to move piston 72 to its uppermost position per FIG 2. As piston 72 begins to rise from its lowermost position: chamber 52 is full of liquid, gas having been vented through vent valve 54; the upper cylindrical portion of piston 72 contacts annular seal 88 to stop back flow from chamber 52 to formation 14; annular seal 85 prevents fluid flow between piston 72 and inner wall 84; spring 76 is progressively compressed to store energy sufficient for returning piston 72 to its lowermost position; liquid in chamber 52, being confined and increased in pressure to a pressure level greater than the pressure level in tubing 22 immediately above endwall 48 by upward movement of piston 72, causes conventional check valve 50 to open and allow produced well fluid to flow from chamber 52 into tubing 22 and thence toward the surface.

Continued flow of power fluid (F) from pressure source (P) through conduit 66, valve 62, conduit 68, annulus 28, around the lower end of tubular member 53, upwardly within tubular member 53 to act upwardly against the lower end of piston 72 causes: continued compression of spring 76; continued flow of liquid within chamber 52 to flow toward the surface; check valve 50 to remain open for passage of the produced liquid; piston 72 to expel substantally all fluid from pump chamber 52 so as to achieve a maximum volumetric efficiency as piston 72 reaches its uppermost position as shown in FIG. 2. Immediately after piston 72 reaches its uppermost position, continued input of fluid (F) from pressure source (P) causes the pressure level of power fluid (F) to increase to a predetermined pressure level in excess of that required to raise piston 72 to its uppermost position, whereupon preset pressure switch 74 causes motor valve 62 to move from the position of FIG. 2 to the position of FIG. 1 such that flow from pressure source (P) is stopped and pressure relief of power fluid (F) within annulus 28 is accomplished by the flow of power fluid (F) through conduit 68, valve 62, and conduit 75 to tank 64. Pressure relief valve 82 may be preset to maintain the pressure level within tank 64 at any desired level so as to maintain the pressure of fluid (F) below piston 72 within a desired operating range as determined by the fluid pressure level within formation 14 and other well conditions.

As the pressure level of power fluid (F) is relieved to a predetermined value, the force of compressed spring 76 is sufficient to return piston 72 to its lowermost position as shown in FIG. 1, displacing a volume of fluid from tubular member 53 and a like volume from annulus 28 into tank 64, whereupon: pump chamber 52 is again empty; piston 72 is disengaged from annular seal 88 so as to allow well fluid to again flow from formation 14, through conduits 86 into chamber 52 and begin another cycle. As Piston 72 begins its downward movement, check valve 50 closes to prevent back flow of liquid from tubing 22 into chamber 52 causing a partial vacuum to occur within chamber 52 which in addition to the fact that no liquid is present within chamber 52 to provide bouancy for vent valve 54, causes vent valve 54 to open due to its own weight.

Should power source (P) comprise a pump, power fluid (F) may be recirculated from tank 64 through check valve 80 and conduit 78 to the pump intake, the pump being sufficient to provide fluid power for proper operation of the downhole pump as previously described.

Since gas is vented through vent valve 54 and pump chamber 52 is full of liquid as piston 72 begins its upward pump stroke and since vent valve 54 opens to allow further venting of gas to the surface as piston 72 begins its downward stroke, no pressurized gas can be trapped within chamber 52 to prevent a free flow of well fluid into chamber 52 from formation 14 as may occur in conventional downhole pumps, such an adverse condition being known as vapor-lock. Therefore it is clear that the present invention is not subject to vapor-lock which will allow pump strokes with pump chambers only partially filled with liquid which causes reduced efficiency per stroke, reduced production rates of well fluids and waste of energy due to recompression of gas trapped in the pump chamber.

It is also clear that the present invention initiates a pump stroke only when the formation production rate has caused the pump chamber to be filled with liquid which prevents adverse effects that may occur in conventional bottom hole pumps such as the waste of energy due to pump strokes on partially filled pump chambers and extreme wear of pump parts due to the lack of produced liquid to carry off the heat of friction between the pump parts.

It is also clear that the system and method of operation of the present invention maintains the power fluid for operation of the bottom hole pump separate from produced well fluids so as to prevent contamination of the power fluid and the need to replace it, which in turn allows for optimum selection of power fluid regardless of well fluids produced.

It is also clear that the present invention automatically adjusts to changing well production rates and without the need for expensive time consuming well tests and calculations as is required by conventional systems and methods.

Installation and operation of the preferred construction for the pump of the present invention as depicted in FIG. 3 may be as follows. Casing 126 and screen 132 may be set in a conventional manner after which, casing 124 may be run inside of casing 126 to a depth near the producing formation such that shoulder 134 is properly positioned to later receive the downhole pump. Casing 124 may be suspended and sealed in a conventional wellhead assembly so as to provide flow passages as schematically shown in FIGS. 1 and 2. Before lowering the downhole pump into casing 124, enlarged bore 312, passage 317 and a portion of chamber 176 above bladder 303 is filled with a suitable oil or other operating fluid compatable with all parts contacted. Chamber 176 below bladder 303 is then filled with a gas at a suitable pressure for given well conditions so as to provide a spring action as previously described. Annulus 128 below annular piston 201 and passage 316 may be similarly filled. The downhole pump, substantially contained within tubular member 253, may then be attached to the lower end of tubing 122 by any suitable means and lowered into casing 124 in a conventional manner to the depth that shoulder 136 of tubular member 253 lands on shoulder 134 of casing 124 so as to support the weight and fluid forces acting thereon and so as to activate seals 137 and 138 and thereby seal annulus 128 from annulus 130. Tubing 122 may then be suspended from and sealed with a conventional well head so as to provide flow passages and system components as schematically depicted in FIGS. 1 and 2.

Tank 64 and annulus 128 above annular piston 201 may then be filled with suitable power fluid (F) for pumping action as previously described. Beginning with piston 172 in the lowermost position as depicted in FIG. 3, well fluid comprising both liquid and gas may flow through conduits as at 112 over the top of piston 172 and into pump chamber 152. While liquid is not present in chamber 152 at the level of float 155, vent valve 154 remains open and vents formation gas into annular chamber 252, through check valve 244 and up annulus 130 toward the surface. As chamber 152 becomes filled with liquid from the formation, formation gas having been vented through vent valve 154, the presence of liquid around float 155 provides sufficient bouancy so as to close vent valve 154 and thereby prevent flow of liquid into the vent. The closing of vent valve 154 moves stem 158 which triggers generator-transmitter 156 to cause pressurization of power fluid (F) in annulus 128 as previously described. Power fluid (F) then flows from annulus 128 up passage 316 to chamber 313 at sufficient pressure to act against the lower surface of end wall 315 and thereby cause piston 172 to rise against the forces of well liquid above piston 172 and against the fluid pressure within enlarged bore 312 acting against the lower end wall of piston 172. Chamber 176 may be large with respect to the volume of enlarged bore 312 so as to provide a substantially constant spring force acting downwardly on piston 172, however, as piston 172 moves upwardly, fluid is forced from enlarged bore 312 down passage 317 and into chamber 176 so as to move bladder 303 downwardly and thereby further compress gas below the bladder which stores energy for later use to return piston 172 to its lowermost position. As the upper cylindrical surface of piston 172 contacts annular seal 188, back flow of liquid from chamber 152 to formation 140 is stopped which allows an increase of pressure for the liquid within chamber 152 which in turn causes check valve ball 150 to open and allow flow of liquid from chamber 152 into tubular member 251 and thence up tubing 122 toward the surface.

As piston 172 reaches the uppermost position, continued prepressurization of annulus 128 causes an increase in pressure above that required to raise piston 172 which in turn causes pressure switch 74 to relieve pressure within annulus 128 as previously described which in turn allows stored energy of compressed gas within chamber 176 to force operating fluid from chamber 176 up passage 317 and into enlarged bore 312 so as to act against the lower end wall of piston 172 so as to return piston 172 to its lowermost position. As piston 172 moves downwardly, upper end wall 315 acts against operating fluid within chamber 313 to force it through passage 316 and into annulus 128 to then move up annulus 128 and cause annular piston 201 to rise to its uppermost position against the reduced pressure of power fluid (F). As piston 172 begins to descend, float 155 is no longer immersed in liquid and so loses the buoancy that effected closing of vent valve 154 such that the weight of vent valve causes it to open and return chamber 152 to the pressure of vent annulus 130. Simultaneously, liquid pressure above ball check 150 causes the ball to close and prevent back flow of the liquid into chamber 152. When piston 172 thus returns to its lowermost position, conduits as at 186 are once again open for another pump cycle to begin as the liquid production rate of the well may determine at a constant or eratic rate of production.

Should it be necessary to remove the bottom hole pump from the well for any reason, tubing 122 may be pressured internally from the surface to a pressure level required to act against the pressure defined within the diameter of seal 245 so as to shear pins 247 and to cause shoulder 236 at the lower end of tubing 122 to move upwardly with respect to shoulder 241 such that fluid may flow between the interior of tubing 122 and annulus 128 which allows displacement of power fluid (F) from annulus 128 to the surface simply by pumping a heavier liquid down tubing 122, so as to recover the power fluid for future use before the seal at the bottom of casing 124 is broken, causing contamination by inflow of well fluids into annulus 128. Tubing 122 may then be pulled from the well in a conventional manner which in turn, lifts the downhole pump from its mounting on shoulder 134, to the surface.

It is thus made clear that a compact and efficient pump construction is provided by the present invention as is necessary to operate in accord with the method of and in cooperation with the system of the present invention so as to gain all of the advantages and objectives thereof.

Other embodiments, advantages and uses of the present invention will become evident to those skilled in the art upon study of this teaching and upon review of the drawings attached hereto.

I claim:

1. A system for pumping liquid from a well suitable for use with a well capable of producing both gas and liquid, comprising:

a string of production tubing mounted within the wellbore;

pump means sealably mounted within said tubing and including a chamber for receiving well fluids through port means and a reciprocating means in said chamber;

vent means in said chamber for venting gas and vapor to the surface and including a vent valve which closes only when said chamber is substantially void of gas and vapor;

check valve means interconnecting said chamber and said production tubing for permitting fluid flow from said chamber during the power stroke of said reciprocating means;

means for detecting when said chamber is substantially void of gas and vapor;

means for closing said vent means when said chamber is substantially void of gas and vapor;

means for closing said port means when said chamber is substantially void of gas and vapor;

means for actuating the power stroke of said reciprocating means when said chamber is substantially void of gas and vapor to force the well liquids in said chamber through said check valve means; and means for returning said reciprocating means to its at rest position.

2. A method for pumping liquid from a well suitable for use in a well capable of producing both gas and liquid, comprising:

positioning a pump means including a chamber for receiving well fluids through a port means and a reciprocating means in said chamber in fluid communication with a production tubing and in or below the liquids in said well;

filling said chamber with well fluids through said port means while said reciprocating means is on its return stroke or at rest;

venting any gas and vapor entering or produced in said chamber through a gas vent means which remains open until said chamber is substantially void of gas and vapor;

detecting when said chamber is substantially void of gas and vapor;

closing said vent means when said chamber is substantially void of gas and vapor;

actuating the power stroke of said reciprocating means when said chamber is substantially void of gas and vapor;

closing said port means when said chamber is substantially void of gas and vapor;

forcing said well liquids in said chamber into said production tubing through a check valve means during the power stroke of said reciprocating means; and returning said reciprocating means to its at rest position.

3. The method of claim 2 wherein said port means is closed as said reciprocating means moves into sealing contact with a seal means in said chamber following actuation of said power stroke.

4. A pump for pumping liquids from a well suitable for use with a well capable of producing both gas and liquid, comprising:

a chamber for receiving well fluids from the wellbore;

port means for said well fluids to enter said chamber;

reciprocating means in said chamber for cooperation with said chamber to pump the liquids in said well fluids;

vent means in said chamber for venting gas and vapor to the surface and including a vent valve which closes only when said chamber is substantially void of gas and vapor;

check valve means capable of interconnecting said chamber with a production tubing for permitting fluid flow from said chamber during the power stroke of said reciprocating means;

means for detecting when said chamber is substantially void of gas and vapor;

means for closing said vent means when said chamber is substantially void of gas and vapor;

means for closing said port means when said chamber is substantially void of gas and vapor;

means for actuating the power stroke of said reciprocating means when said chamber is substantially void of gas and vapor to force the well liquids in said chamber through said check valve means; and means for returning said reciprocating means to its at rest position.

5. The pump of claim 4 further comprising spring means cooperating with said reciprocating means to return said reciprocating means to its rest position at the completion of the power stroke.

6. The pump of claim 5 wherein said spring means is a mechanical spring.

7. The pump of claim 5 wherein said spring means is a compressible, inert gas spring.

8. The pump of claim 4 wherein said reciprocating means is powered by an hydraulic system comprising a conduit for communicating a pressurized fluid to one side of said reciprocating means.

* * * * *